US009429879B2

(12) United States Patent
Watanabe et al.

(10) Patent No.: US 9,429,879 B2
(45) Date of Patent: Aug. 30, 2016

(54) IMAGE FORMING APPARATUS HAVING IMAGING UNITS USING TONER WITH DIFFERENT PARTICLE SIZES

(71) Applicant: FUJI XEROX CO., LTD., Tokyo (JP)

(72) Inventors: Sho Watanabe, Kanagawa (JP); Satoshi Shigezaki, Kanagawa (JP); Yoko Miyamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/624,915

(22) Filed: Feb. 18, 2015

(65) Prior Publication Data

US 2016/0048095 A1 Feb. 18, 2016

(30) Foreign Application Priority Data

Aug. 18, 2014 (JP) ..... 2014-166078

(51) Int. Cl.
*G03G 15/16* (2006.01)
*G03G 15/01* (2006.01)
*G03G 15/00* (2006.01)

(52) U.S. Cl.
CPC ..... *G03G 15/16* (2013.01); *G03G 15/0126* (2013.01); *G03G 15/0178* (2013.01); *G03G 15/6585* (2013.01); *G03G 15/0189* (2013.01); *G03G 15/1605* (2013.01)

(58) Field of Classification Search
CPC ..... G03G 15/16; G03G 15/0131; G03G 15/1605; G03G 2215/00021
See application file for complete search history.

(56) References Cited

U.S. PATENT DOCUMENTS

2013/0251411 A1* 9/2013 Miura ..... G03G 15/6585 399/223
2014/0029966 A1* 1/2014 Kojiri ..... G03G 13/22 399/67
2014/0285820 A1* 9/2014 Yasukawa ..... G03G 15/6585 358/1.1

FOREIGN PATENT DOCUMENTS

JP 2004-145324 A 5/2004
JP 2004-233914 A 8/2004
JP 2011-174970 A 9/2011

* cited by examiner

*Primary Examiner* — David Gray
*Assistant Examiner* — Laura Roth
(74) *Attorney, Agent, or Firm* — Oliff PLC

(57) ABSTRACT

An image forming apparatus includes four first imaging units that use standard toners for colors of yellow, magenta, cyan, and black, respectively. The image forming apparatus further includes a second imaging unit that uses a toner having a particle size smaller than a smallest one of particle sizes of the four standard toners. The image forming apparatus also includes a transfer unit that transfers first images formed by the respective first imaging units and a second image formed by the second imaging unit to a recording medium such that the first images are provided on the recording medium and the second image is provided on the first images.

3 Claims, 9 Drawing Sheets

FIG. 4

| | PARTICLE SIZE OF STANDARD TONER (LOWER-LAYER TONER) [μm] | PARTICLE SIZE OF SPECIAL TONER (UPPER-LAYER TONER) [μm] | IMAGE NONUNIFORMITY |
|---|---|---|---|
| WORKING EXAMPLE 1 | 5.8 | 3.8 | GOOD |
| WORKING EXAMPLE 2 | 7.5 | 5.8 | GOOD |
| COMPARATIVE EXAMPLE 1 | 3.8 | 5.8 | NO GOOD |
| COMPARATIVE EXAMPLE 2 | 3.8 | 7.5 | NO GOOD |

IMAGE FORMING APPARATUS HAVING IMAGING UNITS USING TONER WITH DIFFERENT PARTICLE SIZES

CROSS-REFERENCE TO RELATED APPLICATIONS

This application is based on and claims priority under 35 USC 119 from Japanese Patent Application No. 2014-166078 filed Aug. 18, 2014.

BACKGROUND

Technical Field

The present invention relates to an image forming apparatus.

SUMMARY

According to an aspect of the invention, there is provided an image forming apparatus includes four first imaging units that use standard toners for colors of yellow, magenta, cyan, and black, respectively, a second imaging unit that uses a toner having a particle size smaller than a smallest one of particle sizes of the four standard toners, and a transfer unit that transfers first images formed by the respective first imaging units and a second image formed by the second imaging unit to a recording medium such that the first images are provided on the recording medium and the second image is provided on the first images.

BRIEF DESCRIPTION OF THE DRAWINGS

Exemplary embodiments of the present invention will be described in detail based on the following figures, wherein:

FIG. 4 is a table that summarizes the results of evaluation of images that are output by the image forming apparatus according to the first exemplary embodiment of the present invention and by the image forming apparatus according to the comparative embodiment;

DETAILED DESCRIPTION

First Exemplary Embodiment

An image forming apparatus according to a first exemplary embodiment of the present invention will now be described with reference to FIGS. 1 to 6. In each of the drawings, arrow H representing the vertical direction corresponds to the height direction of the apparatus, and arrow W representing the horizontal direction corresponds to the width direction of the apparatus.

Figure 6:
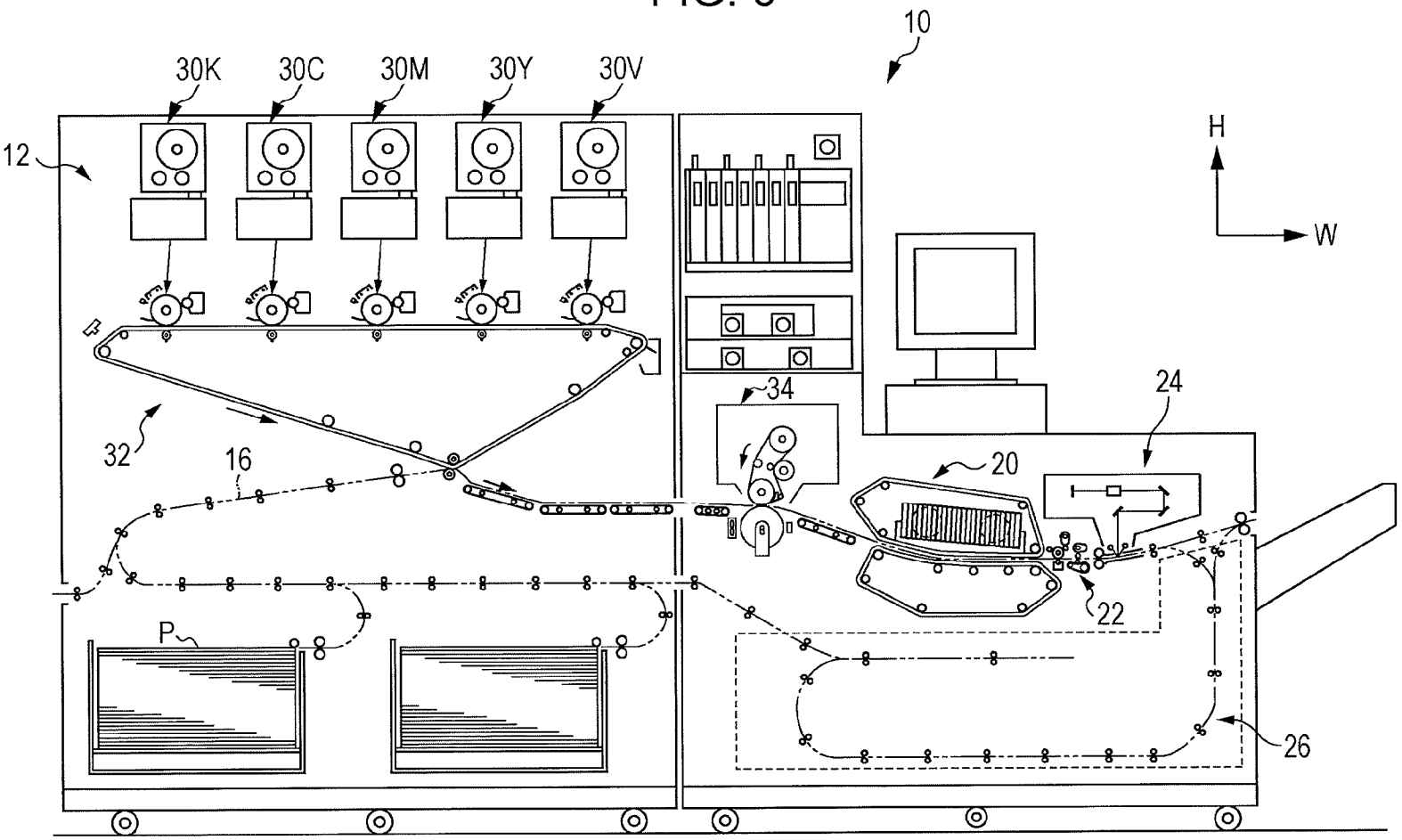
FIG. 6 illustrates the image forming apparatus according to the first exemplary embodiment of the present invention.

Referring to FIG. 6, an image forming apparatus 10 includes an image forming section 12 that forms an image electrophotographically, and plural transporting members (not denoted) that transport, along a transport path 16, a sheet member P (an exemplary recording medium) on which the image is to be formed.

The image forming apparatus 10 further includes a cooling unit 20 that cools the sheet member P on which the image has been formed, a decurling unit 22 that decurls the sheet member P, and an image inspecting unit 24 that inspects the image formed on the sheet member P.

The image forming apparatus 10 further includes a reversal path 26 along which the sheet member P having the image on one side thereof is reversed and is transported toward the image forming section 12 again for the formation of another image on the other side of the sheet member P.

In the image forming apparatus 10 configured as described above, the image forming section 12 forms an image (a set of toner images) on a sheet member P that is transported along the transport path 16, and the sheet member P having the image thereon is transported through the cooling unit 20, the decurling unit 22, and the image inspecting unit 24 in that order and is discharged to the outside of the image forming apparatus 10.

In a case where another image is to be formed on the other side of the sheet member P, the sheet member P already having the image on one side thereof is transported along the reversal path 26, and another image is formed on the other side of the sheet member P by the image forming section 12.

Image Forming Section

Figure 1:
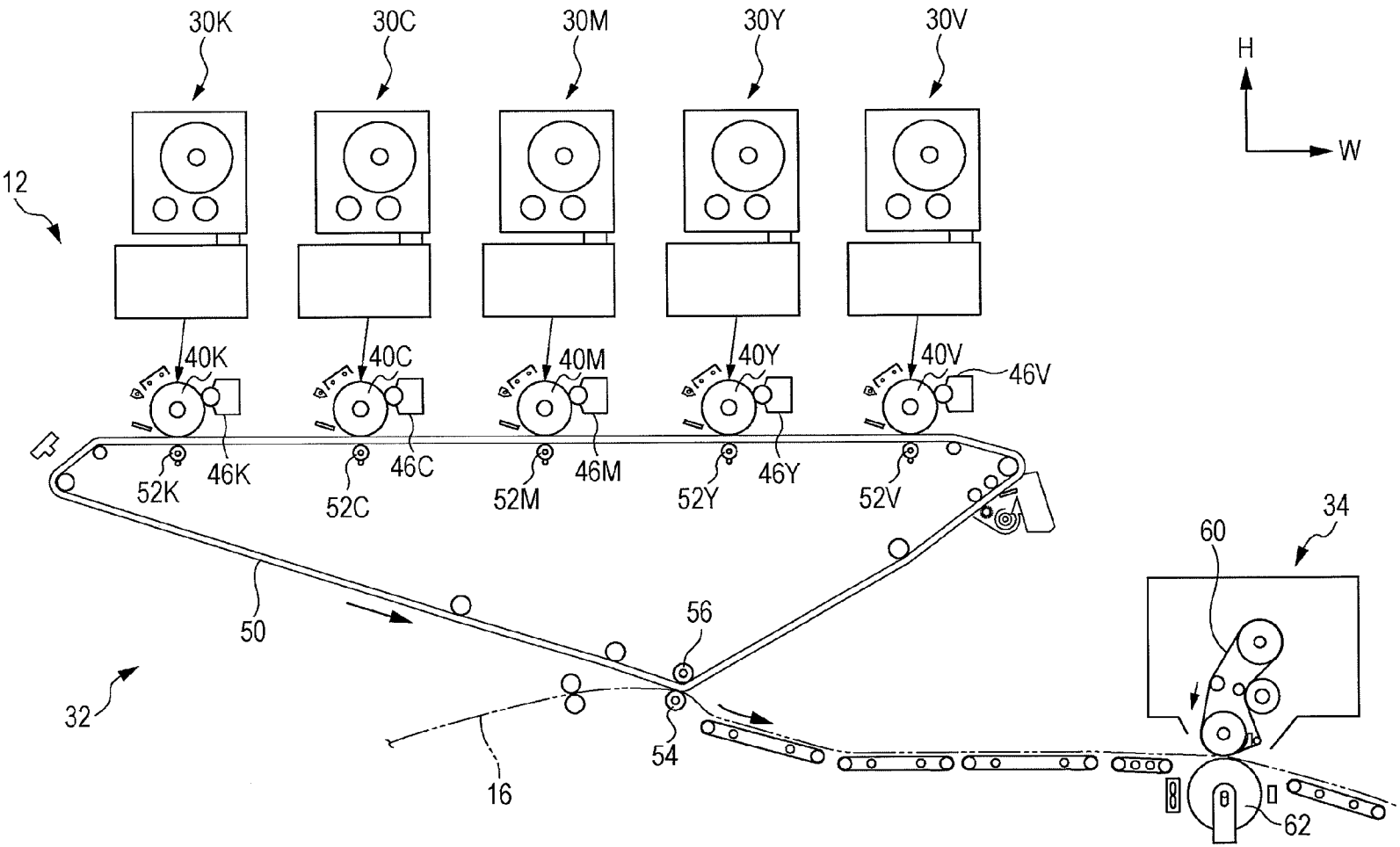
FIG. 1 illustrates an image forming section of an image forming apparatus according to a first exemplary embodiment of the present invention.

Referring to FIG. 1, the image forming section 12 includes plural toner-image-forming units 30 that form toner images in different colors, respectively, and a transfer unit 32 that transfers the toner images formed by the toner-image-forming units 30 to a sheet member P. The image forming section 12 further includes a fixing device 34 that fixes the toner images that have been transferred to the sheet member P by the transfer unit 32 to the sheet member P.

The plural toner-image-forming units 30 are provided so that toner images in respectively different colors are formed. In the first exemplary embodiment, five toner-image-forming units 30 for five respective colors of a special color (V), yellow (Y), magenta (M), cyan (C), and black (K) are provided. Suffixes V, Y, M, C, and K provided to reference numerals in FIG. 1 represent the respective colors. In the first exemplary embodiment, the special color (V) is a transparent color (hereinafter referred to as transparent color (V)) that gives a gloss to the image, whereas yellow (Y), magenta (M), cyan (C), and black (K) are standard colors for outputting a color image. Hereinafter, the suffixes V, Y, M, C, and K provided to reference numerals are omitted if there is no need to distinguish the elements by the colors of the transparent color (V), yellow (Y), magenta (M), cyan (C), and black (K).

Figure 5:
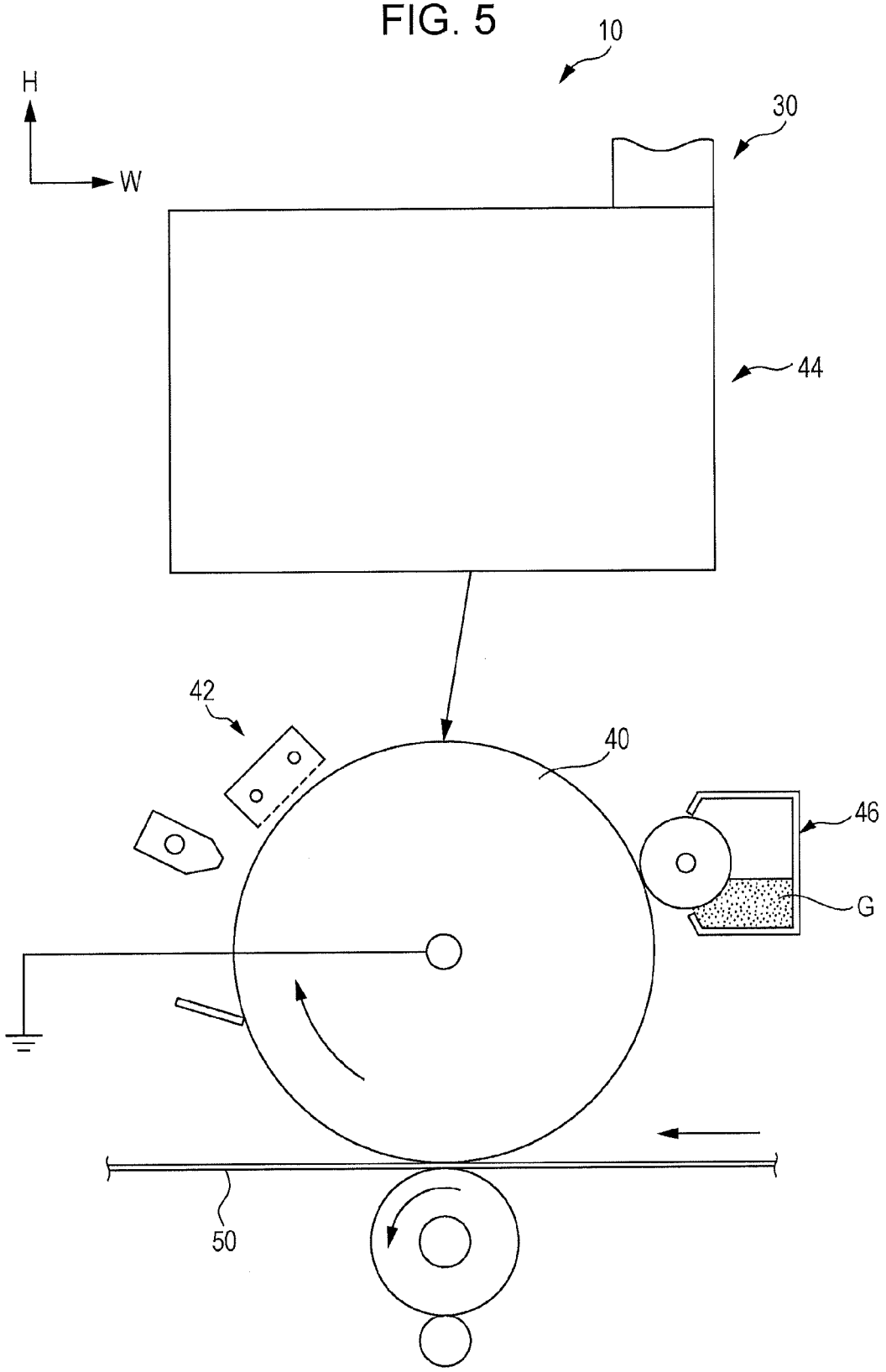
FIG. 5 illustrates one of toner-image-forming units included in the image forming apparatus according to the first exemplary embodiment of the present invention.

The toner-image-forming units 30 provided for the respective colors basically have the same configuration except the toners to be used. Referring to FIG. 5, the toner-image-forming units 30 each include a cylindrical image carrying member 40 that is rotatable, a charger 42 that charges the image carrying member 40, an exposure device 44 that emits exposure light toward the image carrying member 40 having been charged and thus forms an electrostatic latent image on the image carrying member 40, and a developing device 46 that develops the electrostatic latent image into a toner image with a developer G containing a corresponding one of the toners. Details of the developing device 46 will be described separately below.

The image carrying member 40 for each of the colors is in contact with a transfer belt 50 (to be described in detail below) that is rotatable. As illustrated in FIG. 1, the toner-image-forming units 30 for the transparent color (V), yellow (Y), magenta (M), cyan (C), and black (K) are arranged side by side in the horizontal direction in that order from the upstream side in the direction of rotation of the transfer belt 50 (see the arrow illustrated in FIG. 1).

The toner-image-forming units 30Y, 30M, 30C, and 30K (exemplary first imaging units) form images in yellow (Y), magenta (M), cyan (C), and black (K) (exemplary standard colors) with standard toners T1 (see FIG. 2A) for the colors of yellow (Y), magenta (M), cyan (C), and black (K), respectively.

The toner-image-forming unit 30V (an exemplary second imaging unit) forms an image in the transparent color (V) (an exemplary special color) with a clear toner T2 (an exemplary special toner).

The transfer unit 32 includes the transfer belt 50, on which the toner images in the respective colors formed on the respective image carrying members 40 are superposed one on top of another and from which the set of toner images is transferred to a sheet member P. Details of the transfer unit 32 will be described separately below.

As illustrated in FIG. 1, the fixing device 34 includes a fixing belt 60 that is stretched around plural rollers (not denoted) and is to be heated, and a pressure roller 62 that presses the sheet member P against the fixing belt 60.

In such a configuration, the sheet member P to which the set of toner images has been transferred is nipped between the fixing belt 60 that is under rotation and the pressure roller 62, whereby the set of toner images is fixed to the sheet member P.

Featured Configuration

The developing devices 46 included in the toner-image-forming units 30, the particle sizes (volume-mean particle sizes) of the toners used in the developing devices 46, the transfer unit 32, and other featured elements will now be described.

Developing Devices

The developing devices 46 (see FIG. 5) develop the electrostatic latent images on the outer circumferential surfaces of the image carrying members 40 into toner images with the toners T contained in the developers G, respectively.

The standard toners T1 for the standard colors of yellow (Y), magenta (M), cyan (C), and black (K) all have a volume-mean particle size of 5.8 μm. The clear toner T2 for the transparent color (V) has a volume-mean particle size of 3.8 μm. That is, in the first exemplary embodiment, the standard toners T1 have a larger volume-mean particle size than the clear toner T2.

The volume-mean particle sizes of the toners T are measured with a particle-size-distribution-measuring machine COULTER COUNTER (a registered trademark) Multisizer (a trademark) II of Beckman Coulter, Inc., and with an electrolyte ISOTON II of Beckman Coulter, Inc. The measurement is conducted as follows. First, 0.5 mg to 50 mg of a sample is added to a surfactant as a dispersant, for example, 2 ml of a 5% aqueous solution of sodium alkylbenzenesulfonate. The mixture is added to 100 ml to 150 ml of the electrolyte. The electrolyte in which the sample has thus been suspended is dispersed for about one minute with an ultrasonic dispersion machine. Then, the particle-size distribution of the sample is measured with COULTER COUNTER Multisizer II by using an aperture of 100 μm. The number of particles to be measured is 50,000. The particle-size distribution thus measured is graphed in the form of cumulative undersize distribution represented on the basis of predefined particle-size ranges (channels), the values of which become larger from the smallest one. The particle-size range that corresponds to a cumulative percentage of 50% in volume is defined as a volume-mean particle size D50 v, which is taken as the volume-mean particle size of the sample.

Transfer Unit

As illustrated in FIG. 1, the transfer unit 32 includes the transfer belt 50 stretched around the plural rollers (not denoted) and being rotatable in the direction of the arrow illustrated in FIG. 1, and first transfer rollers 52 provided across the transfer belt 50 from the respective image carrying members 40. The first transfer rollers 52 transfer the respective toner images on the image carrying members 40 to the transfer belt 50. The transfer unit 32 further includes a roller 56 that also stretches the transfer belt 50, and a second transfer roller 54 provided across the transfer belt 50 from the roller 56 and that transfers the set of toner images on the transfer belt 50 to a sheet member P.

In such a configuration, the toner images formed by the respective toner-image-forming units 30 are transferred, for the first transfer, to the transfer belt 50 that is under rotation by the respective first transfer rollers 52. Subsequently, the toner images thus transferred to the transfer belt 50 for the first transfer are transferred, for the second transfer, to the sheet member P by the second transfer roller 54.

In the first transfer, the toner images in the transparent color (V), yellow (Y), magenta (M), cyan (C), and black (K) are superposed one on top of another in that order on the transfer belt 50. When the set of toner images is transferred to the sheet member P for the second transfer, the order of the toner images is reversed. That is, in the second transfer, the toner images are superposed on the sheet member P in the order of that in black (K), that in cyan (C), that in magenta (M), that in yellow (Y), and that in the transparent color (V).

In other words, standard-color images (exemplary first images) in the standard colors of black (K), cyan (C), magenta (M), and yellow (Y) are superposed in that order on the sheet member P, and a clear image (an exemplary second image) in the transparent color (V) is superposed over the set of standard-color images.

Other Features

Figure 2A:
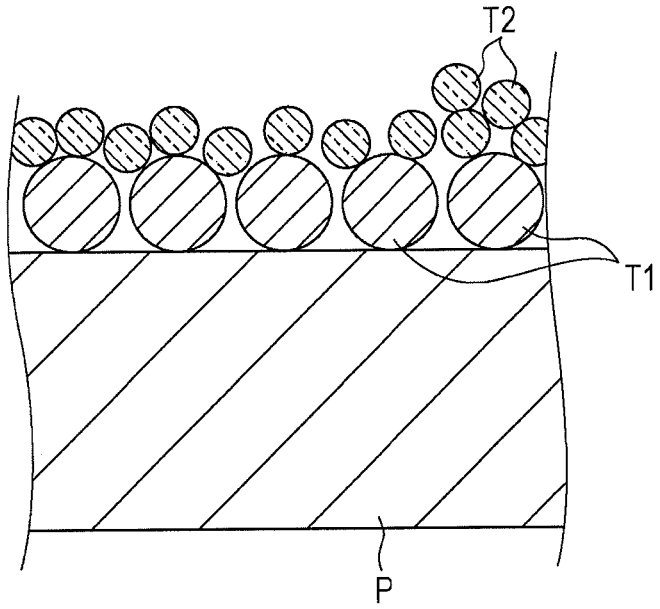
FIGS. 2A and 2B are sectional views of a set of toner images that is output by the image forming apparatus according to the first exemplary embodiment of the present invention.

A set of toner images formed on a sheet member P by the image forming apparatus 10 according to the first exemplary embodiment and a set of toner images formed on a sheet member P by an image forming apparatus according to an embodiment comparative to the first exemplary embodiment will now be described with reference to FIGS. 2A, 2B, 3A, and 3B. In FIGS. 2A and 3A, the difference in the size of toner particles forming the toner images is exaggerated for easy recognition.

First, a set of toner images formed on a sheet member P by the image forming apparatus according to the comparative embodiment will be described with reference to FIGS. 3A and 3B.

Toners used in the image forming apparatus according to the comparative embodiment are a standard toner T5 for magenta (M) having a volume-mean particle size of 3.8 μm, and a clear toner T6 for the transparent color (V) having a volume-mean particle size of 5.8 μm.

In the image forming apparatus according to the comparative embodiment, toner images are formed by using the toner-image-forming unit 30M and the toner-image-forming unit 30V, respectively, whereby an image having a standard color (magenta) with a gloss is output on a sheet member P.

FIG. 3A is a sectional view illustrating a standard-color image formed on the sheet member P and a clear image formed over the standard-color image, the two images being yet to be fixed to the sheet member P. As illustrated in FIG. 3A, some particles of the clear toner T6 having a volume-mean particle size of 5.8 μm push away particles of the standard toner T5 having a volume-mean particle size of 3.8 μm, and are in contact with the sheet member P.

Figure 3A:
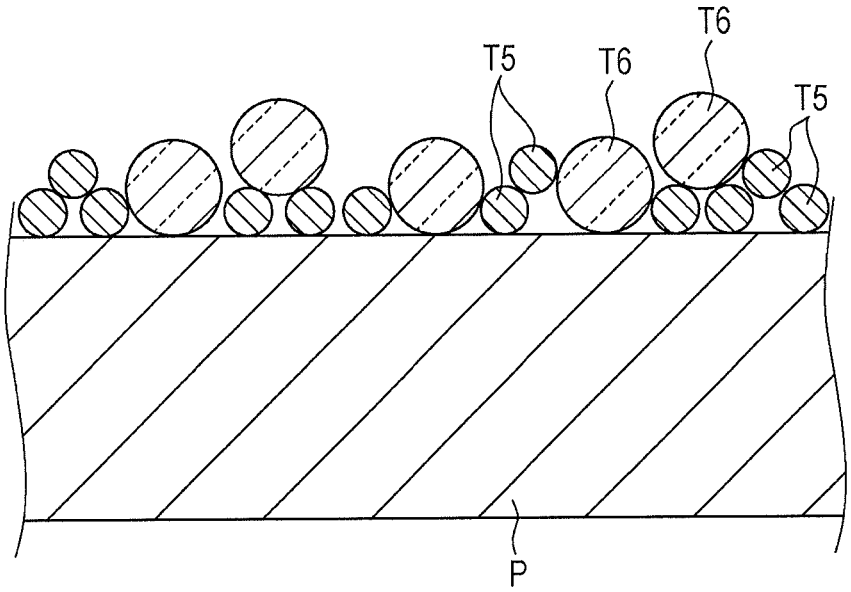
FIGS. 3A and 3B are sectional views of a set of toner images that is output by an image forming apparatus according to an embodiment that is comparative to the first exemplary embodiment of the present invention.
Figure 3B:
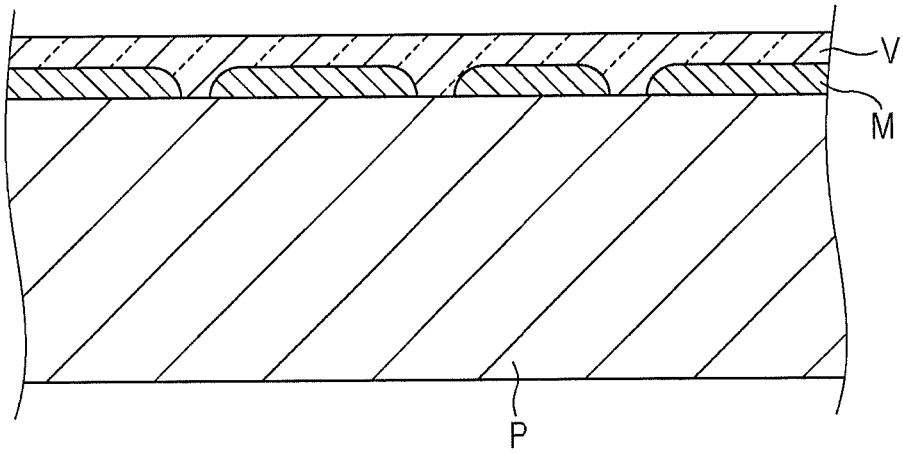

FIG. 3B is a sectional view illustrating the standard-color image and the clear image that have been fixed to the sheet member P. In the state where the standard-color image and the clear image are fixed to the sheet member P as illustrated in FIG. 3B, some portions of the clear image are in contact with the sheet member P. Therefore, the resulting magenta (M) image with a gloss that has been output on the sheet member P has nonuniformity.

Now, a set of toner images formed on a sheet member P by the image forming apparatus 10 according to the first exemplary embodiment will be described with reference to FIGS. 2A and 2B.

Toners used in the image forming apparatus 10 according to the first exemplary embodiment are a standard toner T1 for magenta (M) having a volume-mean particle size of 5.8 μm, and a clear toner T2 for the transparent color (V) having a volume-mean particle size of 3.8 μm. The other specifications of the image forming apparatus 10 are the same as those of the image forming apparatus according to the comparative embodiment.

FIG. 2A is a sectional view illustrating a standard-color image formed on the sheet member P and a clear image formed over the standard-color image, the two images being yet to be fixed to the sheet member P.

Since the standard toner T1 for magenta (M) has a larger volume-mean particle size than the clear toner T2, particles of the clear toner T2 do not push away particles of the standard toner T1, as illustrated in FIG. 2A. Thus, the contact between the particles of the clear toner T2 and the sheet member P is suppressed.

Figure 2B:
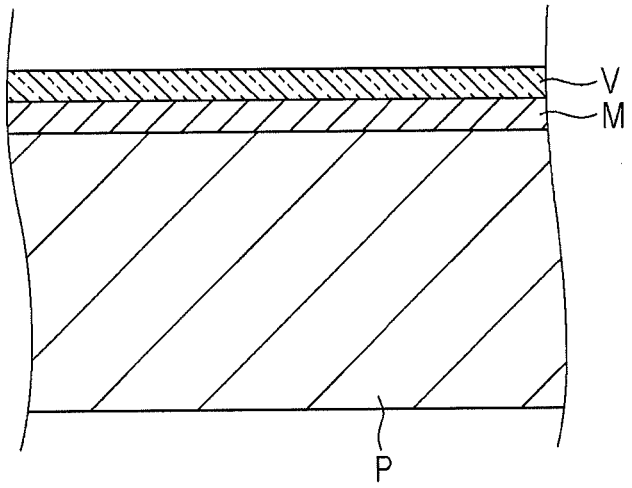

FIG. 2B is a sectional view illustrating the standard-color image and the clear image that have been fixed to the sheet member P. In the state where the standard-color image and the clear image are fixed to the sheet member P as illustrated in FIG. 2B, the clear image is out of contact with the sheet member P. Thus, the occurrence of nonuniformity in the output image is suppressed.

As described above, image nonuniformity may occur in the set of toner images formed by the image forming apparatus according to the comparative embodiment but is suppressed in the set of toner images formed by the image forming apparatus 10 according to the first exemplary embodiment.

Evaluation

Image nonuniformity that may occur in working examples and comparative examples of the first exemplary embodiment is evaluated by using Color 1000 Press of Fuji Xerox Co., Ltd.

Evaluation Method

The evaluation is conducted by using J paper of Fuji Xerox InterField Co., Ltd. having a basis weight of 82 g/m$^2$, and coated paper OS Coat W of Fuji Xerox Co., Ltd. as sheet members P. Toner images are formed on five pieces of J paper and on five pieces of coated paper, i.e., on the total of ten sheet members P, for each of different sets of specifications. Then, nonuniformity in the toner images is evaluated.

The toner images formed are each a patch image of 20 mm×20 mm. The patch image is composed of a standard-color image with an image coverage of 100% and a clear image with an image coverage of 100%, the clear image being formed over the standard-color image, which has the magenta (M) color.

The images thus output are visually examined, and the occurrence of image nonuniformity is evaluated.

SPECIFICATIONS OF EXAMPLES

Specifications of the examples are as follows (see FIG. 4).

1. Working Example 1

Volume-mean particle size of standard toner T1: 5.8 μm
Volume-mean particle size of clear toner T2: 3.8 μm 2. Working Example 2

Volume-mean particle size of standard toner T1: 7.5 μm
Volume-mean particle size of clear toner T2: 5.8 μm 3. Comparative Example 1

Volume-mean particle size of standard toner T5: 3.8 μm
Volume-mean particle size of clear toner T6: 5.8 μm 4. Comparative Example 2

Volume-mean particle size of standard toner T5: 3.8 μm
Volume-mean particle size of clear toner T6: 7.5 μm In each of Working Examples 1 and 2, the standard toner T1 used for the standard-color image formed on the sheet member P has a larger volume-mean particle size than the clear toner T2 used for the clear image formed over the standard-color image.

In each of Comparative Examples 1 and 2, the standard toner T5 used for the standard-color image formed on the sheet member P has a smaller volume-mean particle size than the clear toner T6 used for the clear image formed over the standard-color image.

The other specifications not listed above are all common to Working Examples 1 and 2 and Comparative Examples 1 and 2.

Results

If there is no image nonuniformity or if the level of image nonuniformity is acceptable to the user, the result is regarded as "GOOD." If the level of image nonuniformity is not acceptable to the user, the result is regarded as "NO GOOD."

As summarized in the table illustrated in FIG. 4, the results of Working Examples 1 and 2 are "GOOD," whereas the results of Comparative Examples 1 and 2 are "NO GOOD."

Review

In each of Working Examples 1 and 2, the clear toner T2 has a smaller volume-mean particle size than the standard toner T1, and, as described above, particles of the clear toner T2 do not therefore push away particles of the standard toner T1, suppressing the contact between the clear toner T2 and the sheet member P. Hence, the level of image nonuniformity, if any, is acceptable to the user.

In each of Comparative Examples 1 and 2, the clear toner T6 has a larger volume-mean particle size than the standard toner T5, and, as described above, some particles of the clear toner T6 therefore push away particles of the standard toner T5 and come into contact with the sheet member P. Hence, the level of image nonuniformity is not acceptable to the user.

Summary of Featured Configurations

In the first exemplary embodiment, the standard toner T1 used for the standard-color image formed on the sheet member P has a larger volume-mean particle size than the clear toner T2 used for the clear image formed over the standard-color image. In other words, the standard toner T1 having a relatively large volume-mean particle size is provided as a lower layer lying on the sheet member P, and the clear toner T2 having a relatively small volume-mean particle size is provided as an upper layer lying over the lower layer. As is understood from the results of the above evaluation, such a difference in the particle size of the toners suppresses the occurrence of nonuniformity in the output image.

Second Exemplary Embodiment

Figure 7:
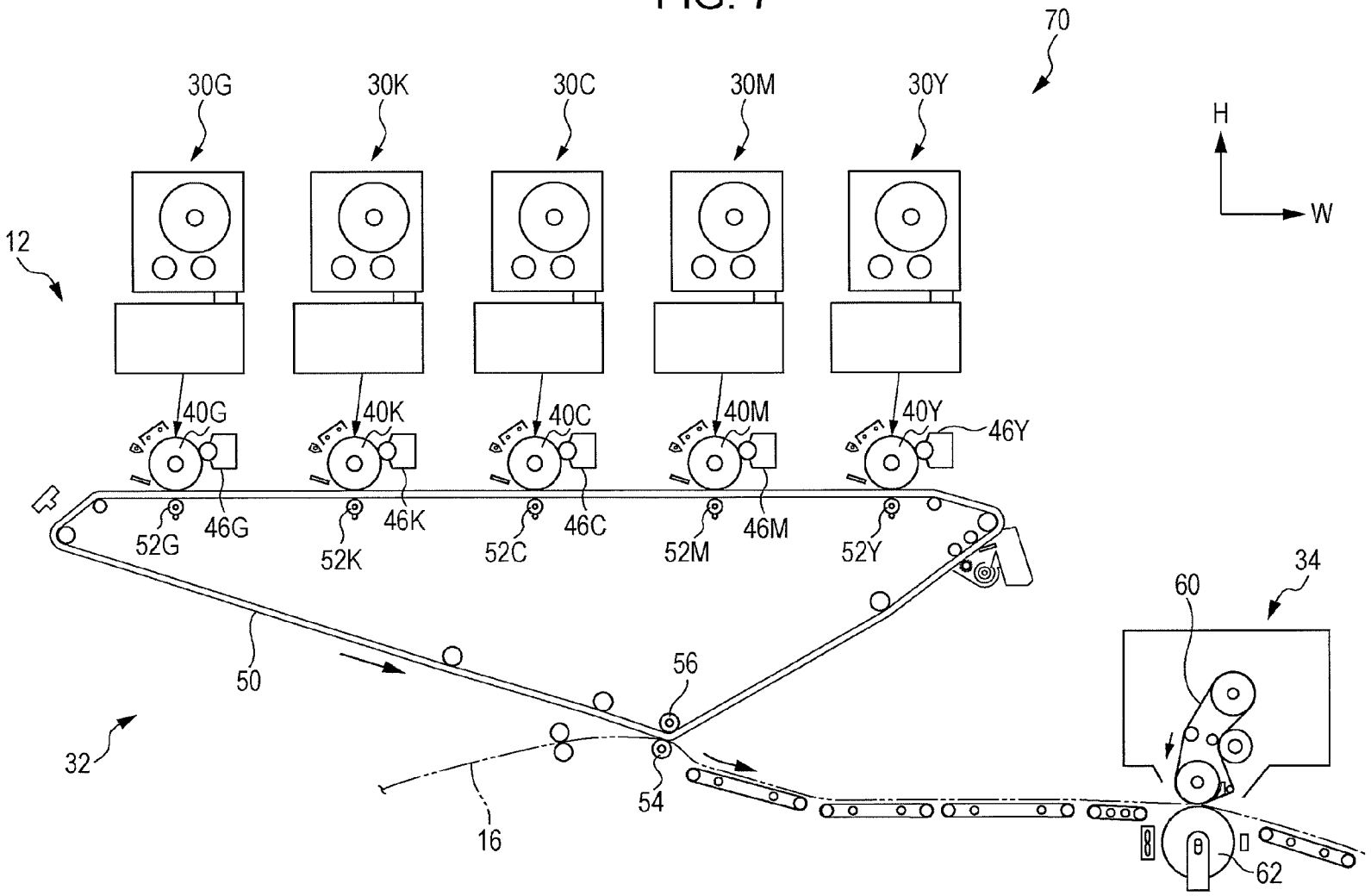
FIG. 7 illustrates an image forming section of an image forming apparatus according to a second exemplary embodiment of the present invention.

An image forming apparatus according to a second exemplary embodiment of the present invention will now be described with reference to FIG. 7. Elements that are the same as those described in the first exemplary embodiment are denoted by corresponding ones of the reference numerals used in the first exemplary embodiment, and description thereof is thus omitted. Differences from the first exemplary embodiment will be discussed basically.

In an image forming apparatus 70 according to the second exemplary embodiment, a green color (hereinafter referred to as green (G)) is employed as a special color that widens the gamut of colors that are reproducible in the output image. As illustrated in FIG. 7, toner-image-forming units 30 for yellow (Y), magenta (M), cyan (C), black (K), and green (G) are arranged side by side in the horizontal direction and in that order from the upstream side in the direction of rotation of the transfer belt 50 (see the arrow illustrated in FIG. 7).

The toner-image-forming units 30Y, 30M, 30C, and 30K (exemplary first imaging units) form standard-color images in yellow (Y), magenta (M), cyan (C), and black (K), respectively. The toner-image-forming unit 30G (an exemplary second imaging unit) forms a green (G) image.

A green toner T3 used for forming the green (G) image has a volume-mean particle size of 5.8 The standard toner T1 used for forming each of the images in the standard colors of yellow (Y), magenta (M), cyan (C), and black (K) has a volume-mean particle size of 3.8 μm.

In such a configuration, the toner images in yellow (Y), magenta (M), cyan (C), black (K), and green (G) are superposed one on top of another in that order on the transfer belt 50 in the first transfer. When the set of toner images is transferred to a sheet member P for the second transfer, the order of the toner images thus superposed is reversed. That is, in the second transfer, the toner images are superposed on the sheet member P in the order of that in green (G), that in black (K), that in cyan (C), that in magenta (M), and that in yellow (Y).

The green toner T3 used for the green image formed on the sheet member P has a larger volume-mean particle size than the standard toners T1 used for the standard-color images formed over the green image. In other words, the green toner T3 having a relatively large volume-mean particle size is provided as a lower layer lying on the sheet member P, and the standard toners T1 having a relatively small volume-mean particle size are provided as an upper layer lying over the lower layer.

As in the first exemplary embodiment, such a difference in the particle size of the toners suppresses the occurrence of nonuniformity in the output image.

Third Exemplary Embodiment

An image forming apparatus according to a third exemplary embodiment of the present invention will now be described with reference to FIGS. 8, 9A, and 9B. Elements that are the same as those described in the first exemplary embodiment are denoted by corresponding ones of the reference numerals used in the first exemplary embodiment, and description thereof is thus omitted. Differences from the first exemplary embodiment will be discussed basically.

An image forming apparatus 100 according to the third exemplary embodiment employs two special colors: the transparent color (V) that gives a gloss to the image, and the green color (G) that widens the gamut of colors that are reproducible in the output image.

Figure 8:
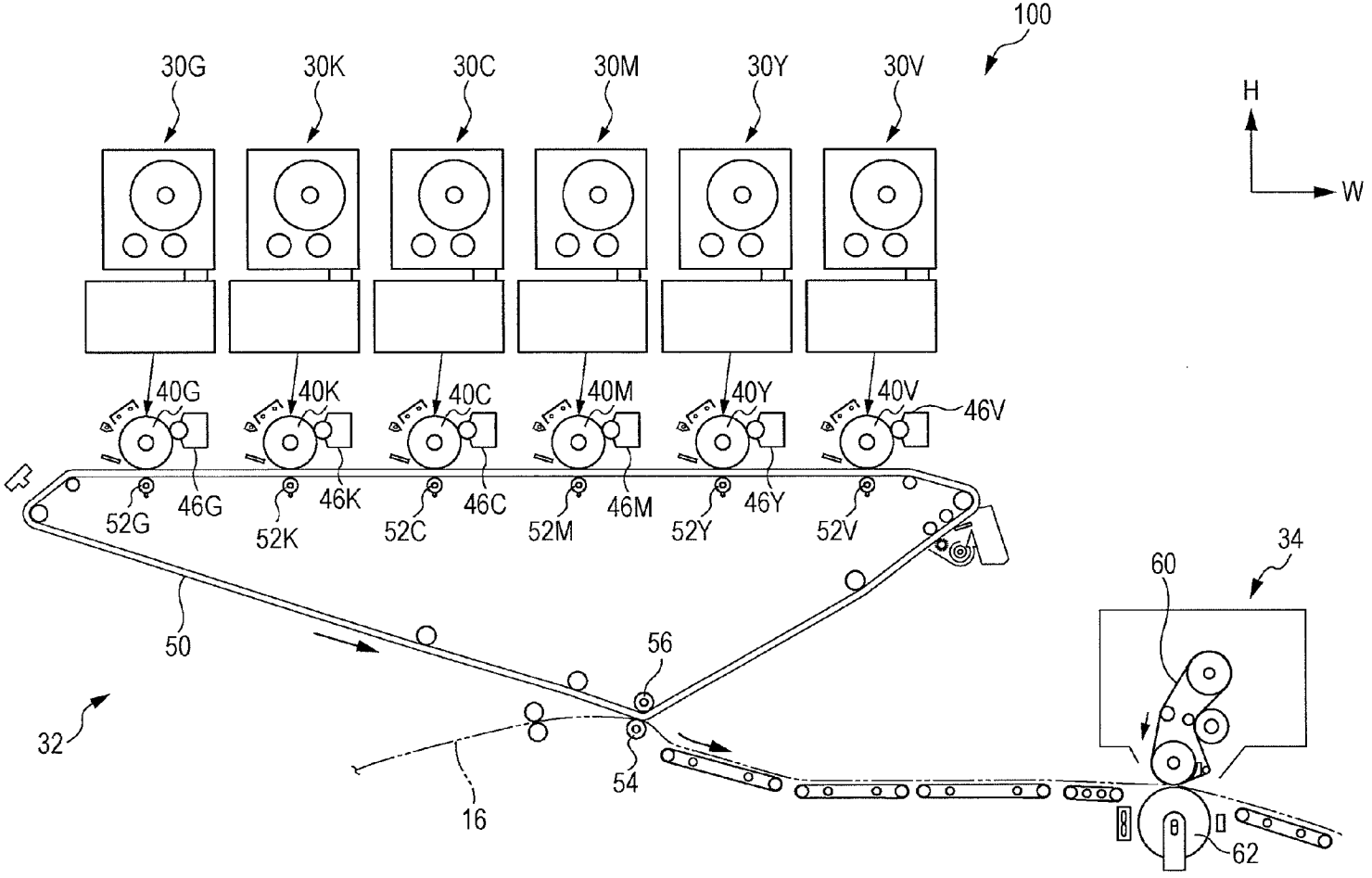
FIG. 8 illustrates an image forming section of an image forming apparatus according to a third exemplary embodiment of the present invention.

As illustrated in FIG. 8, toner-image-forming units 30 for the transparent color (V), yellow (Y), magenta (M), cyan (C), black (K), and green (G) are arranged side by side in the horizontal direction and in that order from the upstream side in the direction of rotation of the transfer belt 50 (see the arrow illustrated in FIG. 8).

The toner-image-forming units 30Y, 30M, 30C, and 30K (exemplary first imaging units) form standard-color images in yellow (Y), magenta (M), cyan (C), and black (K), respectively. The toner-image-forming unit 30G (an exemplary second imaging unit) forms a green (G) image. The toner-image-forming unit 30V (an exemplary third imaging unit) forms a transparent image, i.e., a clear image.

The green toner T3 used for forming the green (G) image has a volume-mean particle size of 7.5 μm. The standard toner T1 used for forming each of the images in the standard colors of yellow (Y), magenta (M), cyan (C), and black (K) has a volume-mean particle size of 5.8 μm. The clear toner T2 used for forming the clear (V) image has a volume-mean particle size of 3.8 μm.

In such a configuration, the toner images in the clear color (V), yellow (Y), magenta (M), cyan (C), black (K), and green (G) are superposed one on top of another in that order on the transfer belt 50 in the first transfer. When the set of toner images is transferred to a sheet member P for the second transfer, the order of the toner images thus superposed is reversed. That is, in the second transfer, the toner images are superposed on the sheet member P in the order of that in green (G), that in black (K), that in cyan (C), that in magenta (M), that in yellow (Y), and that in the clear color (V).

The green toner T3 used for the green image formed on the sheet member P has a larger volume-mean particle size than the standard toners T1 used for the standard-color images formed over the green image. Furthermore, the standard toners T1 used for the standard-color images each have a larger volume-mean particle size than the clear toner T2 used for the clear image formed over the standard-color images. In other words, the green toner T3 having a relatively large volume-mean particle size is provided as a lower layer lying on the sheet member P, the standard toners T1 having a relatively middle volume-mean particle size are provided as a middle layer lying over the lower layer, and the clear toner T2 having a relatively small volume-mean particle size is provided as an upper layer lying over the middle layer.

Now, the set of toner images formed on the sheet member P by the image forming apparatus 100 will be described with reference to FIGS. 9A and 9B. In FIG. 9A, the difference in the size of toner particles forming the toner images is exaggerated for easy recognition.

In the image forming apparatus 100, toner images are formed by using the toner-image-forming unit 30G, the toner-image-forming unit 30M, and the toner-image-forming unit 30V, respectively.

Figure 9A:
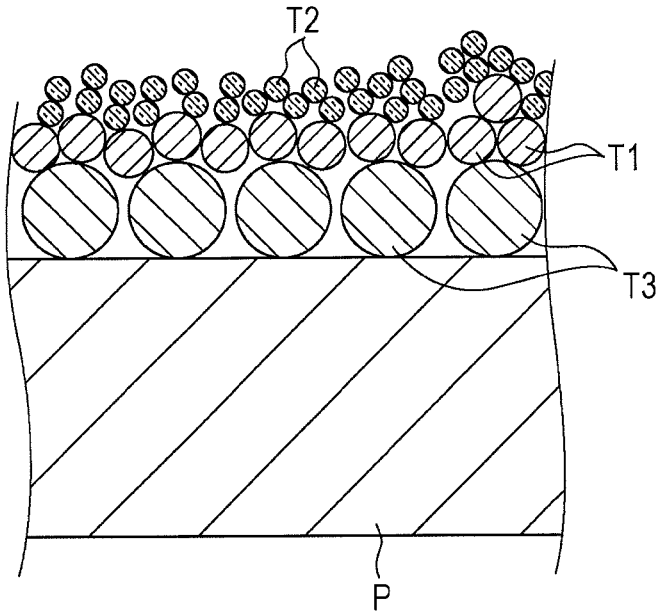
FIGS. 9A and 9B are sectional views of a set of toner images that is output by the image forming apparatus according to the third exemplary embodiment of the present invention.

FIG. 9A is a sectional view illustrating the green image formed on the sheet member P, the standard-color image formed over the green image, and the clear image formed over the standard-color image, the three images being yet to be fixed to the sheet member P. As illustrated in FIG. 9A, since the volume-mean particle sizes of the toners become smaller sequentially from the side of the sheet member P, particles of the toner in the upper layer do not push away particles of the toner in the middle layer, and particles of the toner in the middle layer do not push away particles of the toner in the lower layer.

Figure 9B:
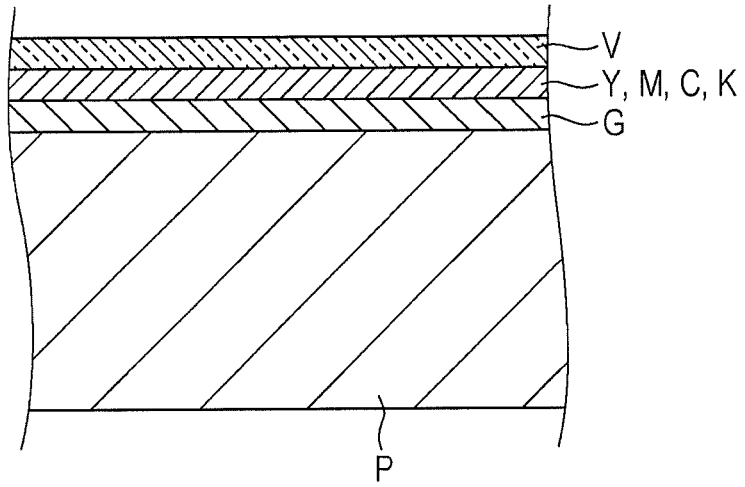

FIG. 9B is a sectional view illustrating the green image, the standard-color image, and the clear image that have been fixed to the sheet member P. As illustrated in FIG. 9B, the green image, the standard-color image, and the clear image are superposed one on top of another in that order on the sheet member P. Thus, the occurrence of nonuniformity in the output image is suppressed.

While the present invention has been described in detail on the basis of some specific exemplary embodiments, the present invention is not limited to those exemplary embodiments. It is obvious to those skilled in the art that the present invention may be embodied in various other ways within the scope thereof. For example, while the above exemplary embodiments each concern a tandem-type image forming apparatus, the image forming apparatus according to the present invention may be a rotary-type image forming apparatus or another kind of tandem-type image forming apparatus that employs a method in which, for example, images on image carrying members are directly transferred to a sheet member.

In the first exemplary embodiment, the standard toners T1 for the respective colors all have a volume-mean particle size of 5.8 Alternatively, the standard toners T1 may have different volume-mean particle sizes. In that case, the clear toner T2 only needs to have a volume-mean particle size smaller than the smallest one of the volume-mean particle sizes of the standard toners T1.

In the second exemplary embodiment, the standard toners T1 for the respective colors all have a volume-mean particle size of 3.8 μm. Alternatively, the standard toners T1 may have different volume-mean particle sizes. In that case, the green toner T3 only needs to have a volume-mean particle size larger than the smallest one of the volume-mean particle sizes of the standard toners T1.

In the third exemplary embodiment, the standard toners T1 for the respective colors all have a volume-mean particle size of 5.8 μm. Alternatively, the standard toners T1 may have different volume-mean particle sizes. In that case, the green toner T3 only needs to have a volume-mean particle size larger than the smallest one of the volume-mean particle sizes of the standard toners T1, and the clear toner T2 only needs to have a volume-mean particle size smaller than the smallest one of the volume-mean particle sizes of the standard toners T1.

The special colors described in the above exemplary embodiment are only exemplary and may alternatively be any of other special colors such as violet, orange, and white.

In each of the second and third exemplary embodiments, the standard toner T1 for the standard color of black (K) has a smaller volume-mean particle size than the green toner T3 for the color of green (G). However, the standard toner T1 for the standard color of black (K) does not necessarily have a smaller volume-mean particle size than the green toner T3.

Suppose that standard-color images and a clear image have been fixed to a sheet member P with a black (K) image forming the upper (or middle) layer. In such a case, even if any portions of the black image are in contact with the sheet member P, the level of nonuniformity in the output image is acceptable to the user. This is because the portions of the black image that are in contact with the sheet member P and portions of the black image that are on the green image have the same color tone. Since the hue of the black (K) color is very low compared with the hues of the other colors, the black (K) color tends to conceal other colors in the lower layers. Therefore, such portions are visually less noticeable as changes in color or as image nonuniformity.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

four first imaging units that use standard toners for colors of yellow, magenta, cyan, and black, respectively;

a second imaging unit that uses a toner having a particle size larger than a largest one of particle sizes of three of the four standard toners that have colors of yellow, magenta, and cyan, wherein the second imaging unit uses a toner for at least one of the colors of green, orange and violet;

a third imaging unit that uses a toner having a particle size smaller than a smallest one of particle sizes of the four standard toners; and a transfer unit that transfers first images formed by the respective first imaging units, a second image formed by the second imaging unit, and a third image formed by the third imaging unit to a recording medium such that the second image is provided on the recording medium, the first images are provided on the second image, and the third image is provided on the first images.

2. The image forming apparatus according to claim 1, wherein the third imaging unit uses toner for a transparent color.

3. The image forming apparatus according to claim 1, wherein the second and third imaging units use toner colors other than the standard toners.

* * * * *